US006273803B1

(12) United States Patent
Wang et al.

(10) Patent No.: US 6,273,803 B1
(45) Date of Patent: Aug. 14, 2001

(54) CARRIERS AND POLISHING APPARATUS

(75) Inventors: Xu-Jin Wang; Shigeto Izumi; Misuo Sugiyama; Hideo Tanaka, all of Ayase (JP)

(73) Assignee: SpeedFam Co., Ltd., Tokyo (JP)

( * ) Notice: Subject to any disclaimer, the term of this patent is extended or adjusted under 35 U.S.C. 154(b) by 0 days.

(21) Appl. No.: 09/346,466

(22) Filed: Jul. 1, 1999

(30) Foreign Application Priority Data

Sep. 8, 1998 (JP) ..... 10-253769

(51) Int. Cl.[7] ..... B24B 29/00
(52) U.S. Cl. ..... 451/288; 451/398
(58) Field of Search ..... 451/288, 285, 451/286, 287, 289, 388, 398

(56) References Cited

U.S. PATENT DOCUMENTS 5,584,751 * 12/1996 Kobayashi et al. ..... 451/288
5,624,299 * 4/1997 Shendon ..... 451/28
5,851,140 * 12/1998 Barns et al. ..... 451/288
6,012,964 * 1/2000 Arai et al. ..... 451/5
6,089,961 * 7/2000 Cesna et al. ..... 451/285

* cited by examiner

*Primary Examiner*—Timothy V. Eley
*Assistant Examiner*—Dung Van Nguyen
(74) *Attorney, Agent, or Firm*—Burr & Brown

(57) ABSTRACT

A carrier and a polishing apparatus are designed to improve the mass producibility of wafers while using a retainer ring formed by a soft material. A rubber sheet 4 is bonded to the bottom surface of a carrier body 2 of the carrier 1 to define a pressure chamber R, a retainer ring 13 formed by a soft material such as EG is bonded to the bottom surface of the sheet 4. A margin block 40 is provided projecting out from the bottom side of the sheet 4, and the thickness of the retainer ring 13 is set to be substantially equal to the sum of the thickness L1 of the margin block 40 and the thickness L2 of the wafer W.

14 Claims, 8 Drawing Sheets

CARRIERS AND POLISHING APPARATUS

BACKGROUND OF THE INVENTION

1. Field of the Invention

The present invention relates to an air pressure type carrier and polishing apparatus provided with a soft retainer ring.

2. Description of the Related Art

In general, polishing a wafer by front side reference gives a higher polishing accuracy than polishing by back side reference, so most carriers adopt an air pressure type structure.

FIG. 13 is a sectional view of an example of an air pressure type carrier of the related art.

A carrier 100 is formed with a depression 101 at its bottom surface. This depression 101 is covered with a sheet 102 to define a pressure chamber R. An air feed path 103 communicating with the pressure chamber R is provided at the center of the carrier 100. A retainer ring 104 for holding the wafer W is attached at the outer periphery of the bottom surface of the carrier 100 by an adhesive (not shown).

Due to this configuration, the carrier 100 can be made to rotate in a state with a wafer W brought into contact with the top of a polishing pad 201 of the rotating lower platen 200. At this time, air is fed from the air feed path 103 to the inside of the pressure chamber R to apply a uniform pressure to the back surface of the wafer W and polish the front surface of the wafer W flat by the polishing pad 201 of the lower platen 200.

In the carrier of the above related art, however, there were the following problems.

Since the retainer ring 104 was in contact with the rotating polishing pad 201 during the polishing of the wafer W, it became worn. In particular, the retainer ring 104 of the related art was set to a thickness of a value in the range from 0.5 mm to 0.7 mm in accordance with the thickness of 6-inch diameter wafers W and 8-inch diameter wafers W. Further, the retainer ring 104 was formed by epoxy glass (EG) or another similarly soft material, so it became worn in a short time, immediately became thinner, and easily peeled off from the carrier 100. Further, when the retainer ring 104 became worn, the wafer W moved upward by the amount of wear of the retainer ring 104 due to the force pressing the wafer against the carrier 100. As a result, the tension caused at the outer periphery of the sheet 102 caused the polishing rate of the outer periphery of the wafer W to become higher than the polishing rate of the center portion, i.e., "face drooping". The degree of face drooping became higher in relation to the amount of wear of the retainer ring 104. From the viewpoint of the allowable degree of face drooping and prevention of peeling, the amount of wear allowed for a retainer ring 104 with a thickness set to a value in the range from 0.5 mm to 0.7 mm is up to about 0.1 mm. Therefore, in a carrier 100 of the related art having a retainer ring 104 set to such a thickness and formed by a soft material such as EG, the number of polishable wafers W produced within the desired range was about 200 sheets, which was extremely poor in terms of mass production.

As opposed to this, it may be considered to form the retainer ring 104 by a ceramic, titanium, or other hard material. While a retainer ring 104 made of a hard material, however, is superior in wear resistance, it is liable to be damaged during polishing work by the outer edge of the wafer W striking the inner peripheral surface of the retainer ring 104.

SUMMARY OF THE INVENTION

An object of the present invention is to provide a carrier and a polishing apparatus designed to improve mass production of wafers while using a retainer ring formed of a soft material.

To achieve the above object, according to a first aspect of the invention, there is provided a carrier comprising: a carrier body having a pressure chamber formed by a depression opening downward covered from below by a pliable sheet; a retainer ring for holding a wafer attached to the outer periphery of the bottom surface of the pliable sheet and formed by a soft material; and a pliable margin block provided projecting out at equal thickness at the bottom surface of the pliable sheet positioned at the inside of the retainer ring, wherein the thickness of the retainer ring set to be substantially equal to the sum of the thickness of the margin block and the thickness of the wafer being polished.

Due to this configuration, when the pressure chamber of the carrier body is filled with a fluid and the wafer is pressed against the rotating lower platen by the carrier body in the state with the wafer placed on the lower platen being held by the retainer ring, the entire surface of the wafer is uniformly pressed by the fluid pressure of the pressure chamber applied to the pliable margin block. Due to this, the wafer is polished to a high accuracy by the rotating lower platen. If the retainer ring contacts the lower platen during the polishing work, the retainer ring formed by the soft material is worn by the rotating lower platen. The thickness of the retainer ring is however set to be substantially equal to the sum of the thickness of the margin block and the thickness of the wafer is set to be much thicker than the retainer ring of the related art, so the retainer ring may be used for a long period of time.

Further, the margin block is provided at an equal thickness on the bottom surface of the pliable sheet. As an example of this, according to an embodiment of the invention, the margin block is formed by a solid rubber member. Further, the thickness of the margin block is set to a value in the range from 2 mm to 4 mm.

As another example of the margin block, according to an embodiment of the invention, the margin block is formed of a hollow rubber member and a plurality of holes communicating the pressure chamber and the hollow part of the margin block are formed in the pliable sheet. Further, according to an embodiment of the invention, the thickness of the margin block is set to a value in the range from 4 mm to 10 mm.

The retainer ring is formed of a soft material. As examples, according to an embodiment of the invention, the retainer ring is formed of a material selected from the group consisting of epoxy glass, polyvinyl chloride, polyacetal, polyimide, polyphenylene sulfide, polyether ether ketone, polyethylene terephthalate, polyether sulfone, polysulfone, polyphenylene oxide, polyarylate, and high density polyethylene.

As an example of the structure for attaching the carrier body, pliable sheet, and retainer ring, according to an embodiment of the invention, the outer periphery of the top surface of the pliable sheet is bonded to the outer periphery of the bottom surface of the carrier body by an adhesive, the top surface of the retainer ring is bonded to the outer periphery of the bottom surface of the pliable sheet by an adhesive, and a plurality of female threaded holes are provided opening to the top surface of the carrier body and passing through the pliable sheet to reach the retainer ring, and male screws are screwed into the female threaded holes to affix the retainer ring. As another example, according to an embodiment of the invention, a ring member is interposed between the outer periphery of the bottom surface of the carrier body and the outer periphery of the top surface of the pliable sheet, the bottom surface of the ring member and the outer periphery of the top surface of the pliable sheet are bonded by an adhesive, the outer periphery of the bottom surface of the pliable sheet and the top surface of the retainer ring are bonded by an adhesive, and a plurality of female threaded holes are provided opening to the top surface of the carrier body and reaching the ring member, and male screws are screwed into the female threaded holes to affix the ring member.

A polishing apparatus using the above carrier also is an invention.

Therefore, according to a second aspect of the present invention, there is provided a polishing apparatus comprising: a rotatable lower platen; a carrier provided with a carrier body having a pressure chamber formed by a depression opening downward covered from below by a pliable sheet, a retainer ring for holding a wafer attached to the outer periphery of the bottom surface of the pliable sheet and formed by a soft material, and a pliable margin block provided projecting out at equal thickness at the bottom surface of the pliable sheet positioned at the inside of the retainer ring; and a rotary drive means for making the carrier rotate while pressing it on top of the lower platen, wherein the thickness of the retainer ring set to be substantially equal to the sum of the thickness of the margin block and the thickness of the wafer being polished.

According to an embodiment of the invention, the margin block of the carrier is formed by a solid rubber member. According to an embodiment of the invention, the margin block of the carrier is formed by a hollow rubber member and a plurality of holes communicating the pressure chamber of the carrier body and the hollow part of the margin block are formed in the pliable sheet.

Further, according to an embodiment of the invention, the retainer ring is formed by a material selected from the group consisting of epoxy glass, polyvinyl chloride, polyacetal, polyimide, polyphenylene sulfide, polyether ether ketone, polyethylene terephthalate, polyether sulfone, polysulfone, polyphenylene oxide, polyarylate, and high density polyethylene.

BRIEF DESCRIPTION OF THE DRAWINGS

The above and other objects, features, and advantages of the present invention will become more readily apparent from the following description of presently preferred embodiments of the invention taken in conjunction with the accompanying drawings, in which.

DESCRIPTION OF THE PREFERRED EMBODIMENTS

Preferred embodiments of the present invention will be explained below with reference to the drawings.

FIRST EMBODIMENT

Figure 1:
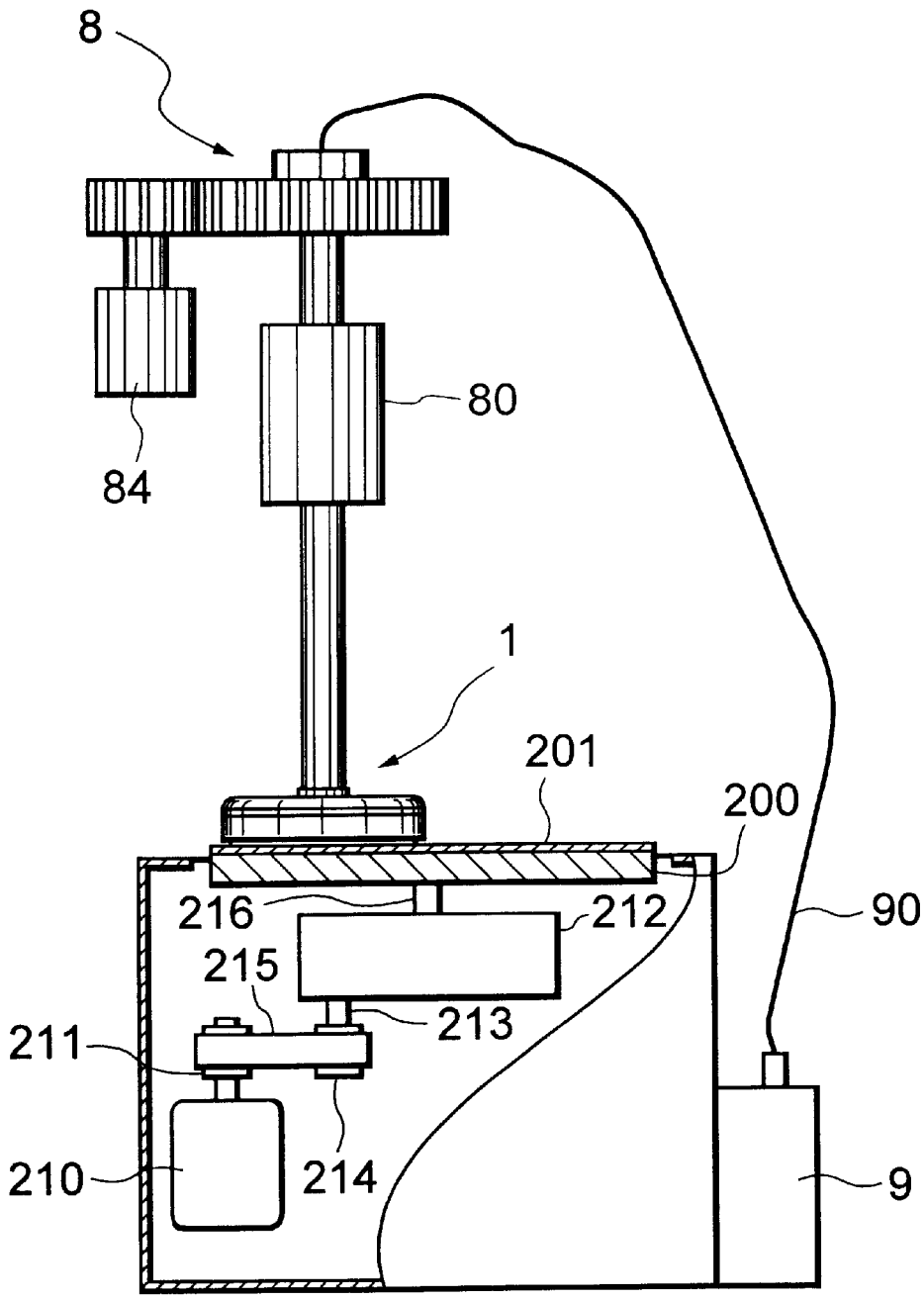
FIG. 1 is a front view of a polishing apparatus according to a first embodiment of the present invention partially cut away.

FIG. 1 is a partially cut away front view of a polishing apparatus according to a first embodiment of the present invention.

As shown in FIG. 1, the polishing apparatus is provided with a lower platen 200 having a polishing pad 201 attached to its front surface, a carrier 1, a rotary drive mechanism 8 serving as the rotary drive means, and an air pump 9 serving as a fluid feed means.

The lower platen 200 is designed to be driven to rotate by a main motor 210 inside the apparatus housing.

A belt 215 is wound around a pulley 211 attached to the main motor 210 and a pulley 214 attached to an input shaft 213 of a transmission 212. The lower platen 200 is attached to an output shaft 216 of the transmission 212.

Due to this, the rotation of the main motor 210 is transmitted to the pulley 214, the rotation of the pulley 214 is converted in speed by the transmission 212 and transmitted to the output shaft 216, and the lower platen 200 is rotated at a predetermined speed.

The rotary drive mechanism 8 is a mechanism for making the carrier 1 rotate while pressing against it and is provided with a cylinder 80 and a motor 84.

Figure 2:
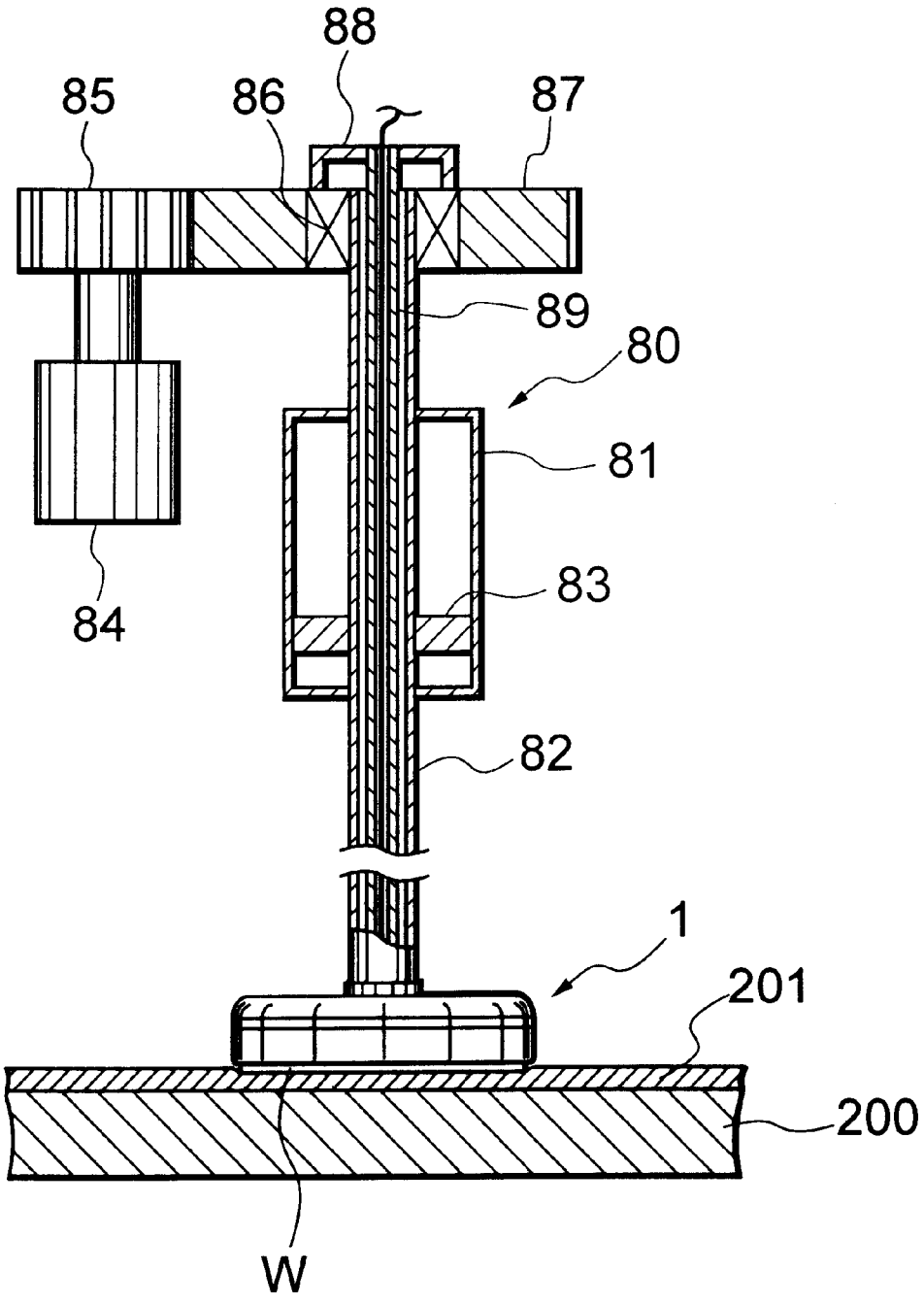
FIG. 2 is a sectional view of a rotary drive mechanism.

FIG. 2 is a sectional view of the rotary drive mechanism 8.

As shown in FIG. 2, the cylinder 80 is comprised of a piston rod 82 passing through the cylinder body 81 and a piston 83 air-tightly fitting in the cylinder body 81 when affixed to the outer side of the piston rod 82.

Due to this, by adjusting the air pressure in the cylinder body 81, it is possible to make the piston rod 82 move up and down integrally with the piston 83 and adjust the pressing force on the carrier 1.

On the other hand, the motor 84 is linked with the piston rod 82 of the cylinder 80. A gear 85 of the shaft of the motor 84 is engaged with a gear 87 attached through a bearing 86 at the top portion of the piston rod 82. The top end of the cylindrical inner rod 89 is affixed to a support member 88 affixed to the top surface of the gear 87.

Due to this, when the motor 84 is driven, the rotation is transmitted to the inner rod 89 through the gears 85 and 87 and the support member 88 and the inner rod 89 rotate at a predetermined speed in the piston rod 82.

The carrier 1 is structured to be able to rotate when the wafer W on the polishing pad 201 of the platen 200 (see FIG. 1) is held and is attached to the lower end of the piston rod 82.

Figure 3:
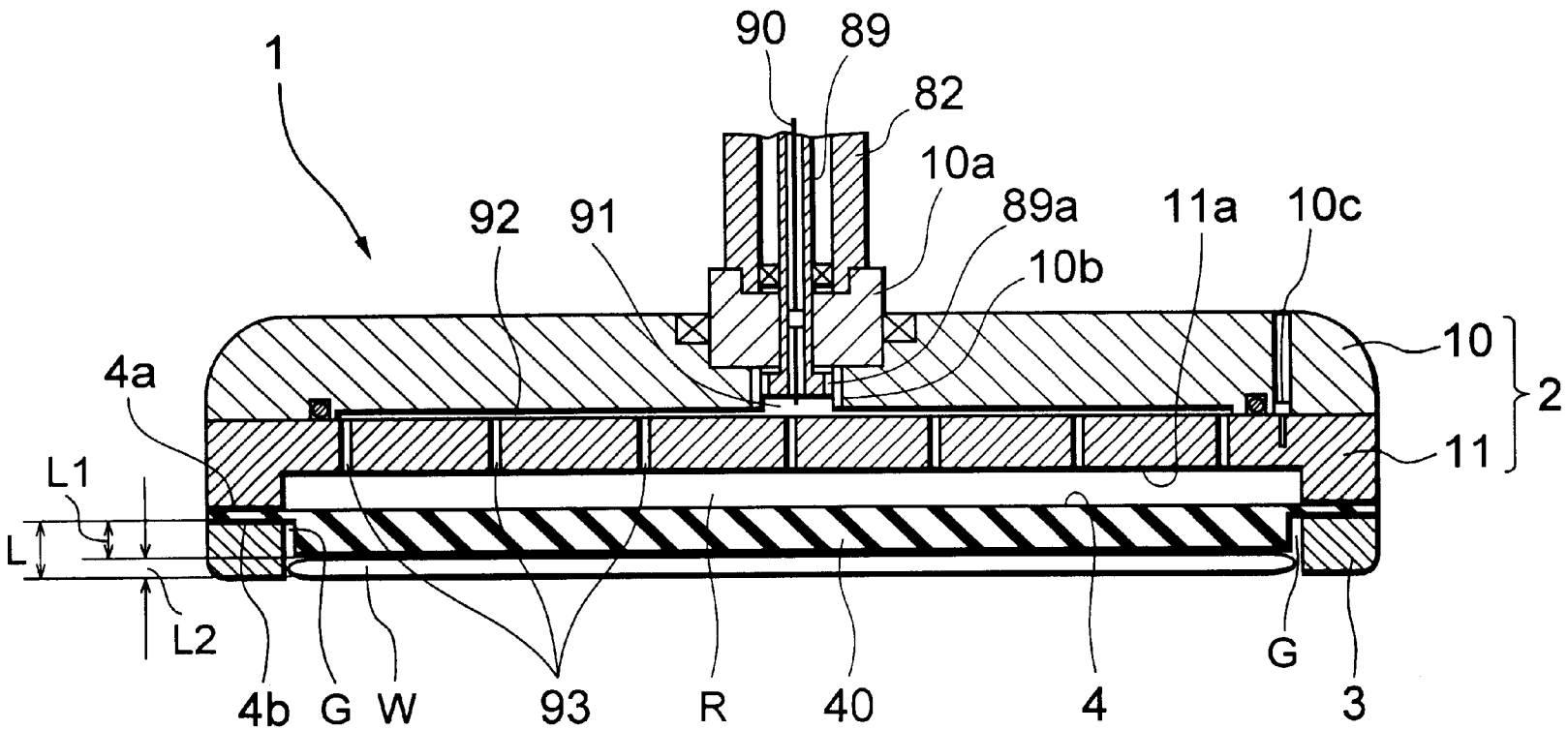
FIG. 3 is a sectional view of the structure of a carrier.
Figure 4:
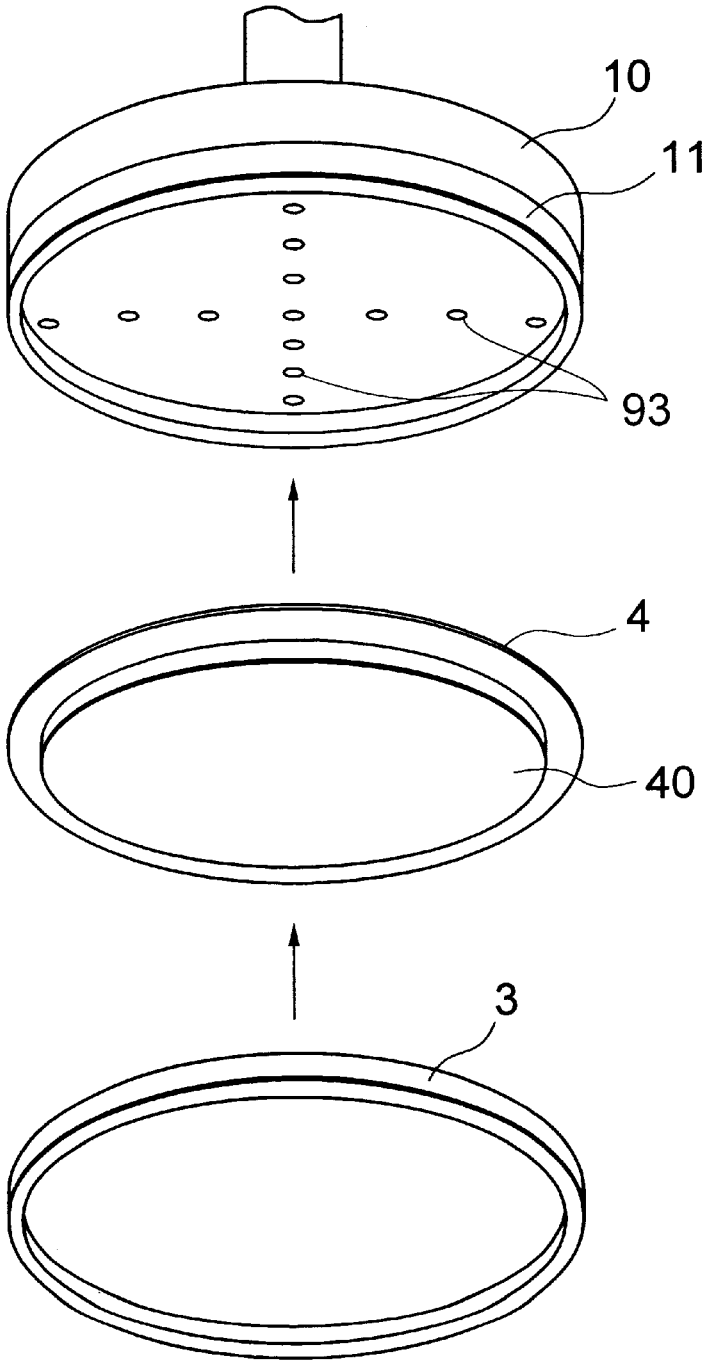
FIG. 4 is a disassembled perspective view of a carrier.

FIG. 3 is a sectional view of the structure of the carrier 1, and FIG. 4 is a disassembled perspective view of the same.

As shown in FIG. 3 and FIG. 4, the carrier 1 is provided with a carrier body 2 and a retainer ring 3 for holding the wafer attached to the bottom side of the carrier body 2.

The carrier body 2 is comprised of a housing 10 and a carrier base 11.

Specifically, the housing 10, as shown in FIG. 3, has a rotatable connecting member 10*a* at its center portion. The lower end of the piston rod 82 is connected to this connecting member 10*a*. Further, this housing 10 has an internal gear 10*b* at the bottom side of the connecting member 10*a*. The internal gear 10*b* engages with an external gear 89*a* formed at the lower end of the inner rod 89 passing through a center hole of the connecting member 10*a*.

Due to this, when the inner rod 89 rotates by being driven by the motor 84, the rotational force of the motor 84 is transmitted to the housing 10 by the engagement of the internal gear 10*b* and the external gear 89*a*.

The carrier base 11 is affixed by screws 10*c* to the bottom surface of the housing 10. At the bottom surface is formed a depression 11*a* opening to the bottom side. This depression 11*a* is covered by a pliable sheet 4 from the bottom side, whereby pressure chamber R is defined. The outer periphery of the top surface of the sheet 4 is air-tightly bonded to the bottom surface of the carrier base 11 by an adhesive 4*a*.

The sheet 4 defining the pressure chamber R is formed by a soft rubber member with a rubber hardness of for example not more than 85° in terms of JIS A. A margin block 40 is provided projecting out from the center of the bottom surface.

The margin block 40 is formed integrally with the sheet 4 and forms a disk of substantially the same shape as the back surface (top surface) of the wafer W. Further, the margin block 40 is solid and uniform in thickness and has a thickness set to a value in the range from 2 mm to 4 mm. The outside diameter of the margin block 40 is set to be smaller than the inside diameter of the retainer ring 3. A gap G of 1 mm to 5 mm is formed between the inner peripheral surface of the retainer ring 3 and the outer peripheral surface of the margin block 40.

The retainer ring 3 is bonded to the outer periphery of the bottom surface of the sheet 4 by an adhesive 4*b*. The retainer ring 3 is formed of a soft material selected from epoxy glass, polyvinyl chloride, polyacetal, polyimide, polyphenylene sulfide, polyether ether ketone, polyethylene terephthalate, polyether sulfone, polysulfone, polyphenylene oxide, polyarylate, and high density polyethylene.

Further, the thickness L of the retainer ring is set to be substantially equal to the sum of the thickness L1 of the margin block 40 and the thickness L2 of the wafer W to be polished. Specifically, when pressing a 0.625 mm thick 6-inch wafer W or a 0.725 mm thick 8-inch wafer W by a margin block 40 set to 2 mm thickness, the thickness of the retainer ring 3 is set to about 2.6 mm or 2.7 mm. When pressing a 0.625 mm thick 6-inch wafer W or a 0.725 mm thick 8-inch wafer W by a margin block 40 set to 4 mm thickness, the thickness of the retainer ring 3 is set to about 4.6 mm or 4.7 mm.

The air pump 9 shown in FIG. 1 is a device using an air hose 90 to feed air of a desired pressure to the pressure chamber R. The air hose 90 extending from the air pump 9 is inserted into the inner rod 89. As shown in FIG. 3, the front end of the air hose 90 reaches the inside of the center hole 91 in the housing 10. This center hole 91 communicates with linear grooves 92 cut radially into the bottom surface of the housing 10. The front ends of the plurality of linear grooves 92 communicate with a plurality of air vents 93 formed through the carrier base 11 and open to the pressure chamber R.

Due to this, the air from the air pump 9 flows through the plurality of linear grooves 92 to the inside of the air vents 93 and is fed to the pressure chamber R. Therefore, by adjusting the pressure of the air by the air pump 9, it is possible to freely control the air pressure in the pressure chamber R.

Next, an explanation will be given of the operation of the polishing apparatus of this embodiment.

At the time of polishing the wafer W, as shown in FIG. 3, the main motor 210 shown in FIG. 1 is driven to make the lower platen 200 rotate at a predetermined speed when is the margin block 40 of the carrier 1 is in contact with the back surface of the wafer W. Simultaneously, the rotary drive mechanism 8 is used to press the carrier 1 holding the wafer W against the lower platen 200 side and make it rotate.

In this state, if air is fed from the air pump 9 to the inside of the pressure chamber R of the carrier 1, the bottom surface of the margin block 40 formed by the soft rubber member deforms in accordance with the unevenness of the back surface of the wafer W and the wafer W is pressed uniformly by the air in the pressure chamber R. The front surface of the wafer W is supported by the polishing pad 201 in that state. Thus, the wafer W is polished by front side reference. Even if the wafer W strikes the retainer ring 3 during the polishing work, since the retainer ring 3 is formed by a soft material such as EG, it will almost never be damaged by being struck by the retainer ring 3.

At the time of polishing the wafer W, however, since the bottom surface of the retainer ring 3 is in contact with the polishing pad 201, the bottom surface of the retainer ring 3 will be worn by the rotating polishing pad 201.

Accordingly, when the thickness is only 0.5 mm to 0.7 mm as in the retainer ring 104 of the related art, wear of only about 0.1 mm will result in the retainer ring 104 easily peeling off from the carrier 100, face drooping occurring at the wafer W, gap forming between the retainer ring 104 and the polishing pad 201, and the wafer W is liable to jump out from the carrier 100.

In the carrier 1 of this embodiment, however, since a margin block 40 of a predetermined thickness is provided projecting out from the bottom side of the sheet 4 and the thickness L of the retainer ring 3 is set to be substantially equal to the sum of the thickness L1 of the margin block 40 and the thickness L2 of the wafer W, even if the retainer ring 3 becomes worn by over 0.1 mm, the retainer ring 3 will not peel off from the sheet 4, face drooping will not occur in the wafer W, and no gap will be formed between the bottom surface of the retainer ring 3 and the polishing pad 201. These points will be explained in more detail below.

Figure 5:
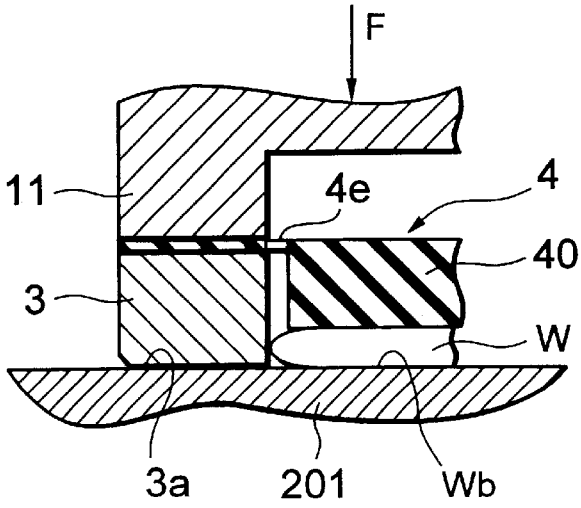
FIG. 5 is a partial enlarged sectional view of a carrier showing the retainer ring in the state without wear at the start of the polishing work.
Figure 6:
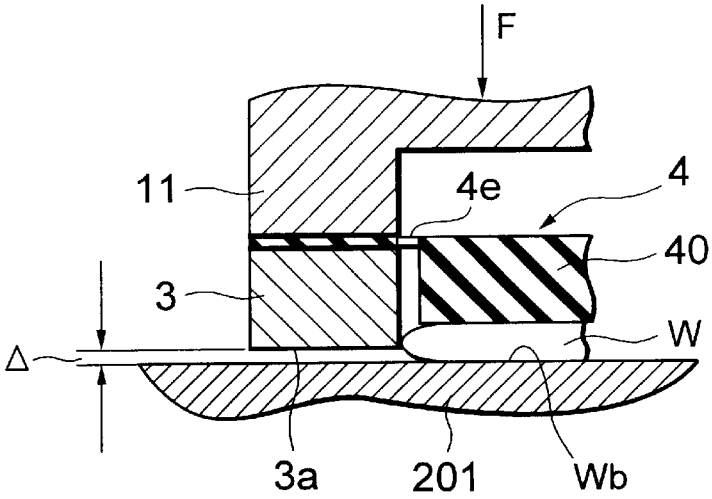
FIG. 6 is a partial enlarged sectional view of a carrier showing the state of formation of a gap.
Figure 7:
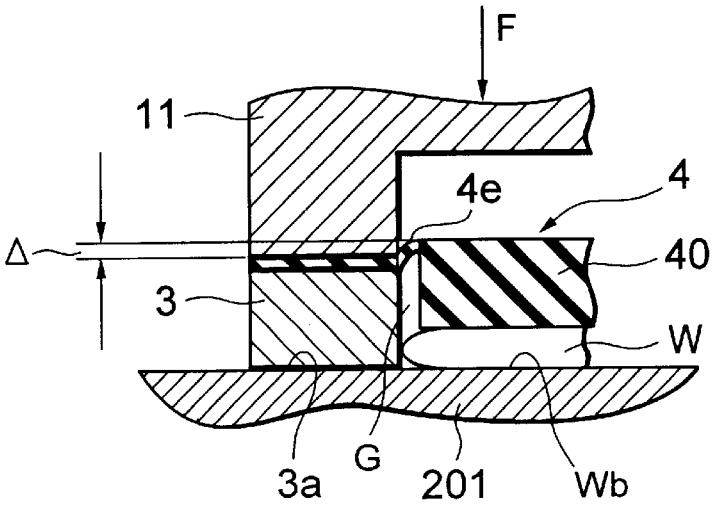
FIG. 7 is a partial enlarged sectional view of a carrier showing the state of flexing of a sheet.

FIG. 5 to FIG. 7 are partial enlarged sectional views of the carrier 1.

As shown in FIG. 5, at the start of the polishing, the bottom surface Wb of the wafer W and the bottom surface 3*a* of the retainer ring 3 are substantially on the same plane. Next, as shown in FIG. 6, when the retainer ring 3 is worn by exactly Δmm, a Δmm gap is produced between the bottom surface 3*a* of the retainer ring 3 and the bottom surface Wb of the wafer W. Force F acts on the carrier 1 in the downward direction, however. Further, the sheet 4 is formed by a soft rubber member. Therefore, as shown in FIG. 7, the sheet portion 4*e* above gap G flexes upward by exactly Δmm when the bottom surface 3*a* of the retainer ring 3 and the polishing pad 201 are kept in contact. At this time, tension occurs at the sheet portion 4*e*, but the vertical component of the tension is completely absorbed by the margin block 40. Therefore, the vertical component of the tension caused at the sheet portion 4*e* will not concentrate at the outer periphery of the wafer W as in the carrier of the related art. Accordingly, even when the amount of flexing of the sheet portion 4*e* is increased to the limit, the phenomenon of face drooping of the wafer W will almost never occur. As a result, the maximum allowable amount of wear of the retainer ring 3 is considered to reach about 10 times the 0.1 mm of the allowable limit of wear of the retainer ring 3 of the related art. Accordingly, the lifetime of the retainer ring 3 is about 10 times the lifetime of the retainer ring 104 of the related art and it is possible to polish a large number of over 1000 wafers W without changing the retainer ring 3. Further, since the state of contact of the retainer ring 3 and the polishing pad 201 is maintained during the polishing work, the wafer W will not be liable to jump out from the retainer ring 3.

SECOND EMBODIMENT

Figure 8:
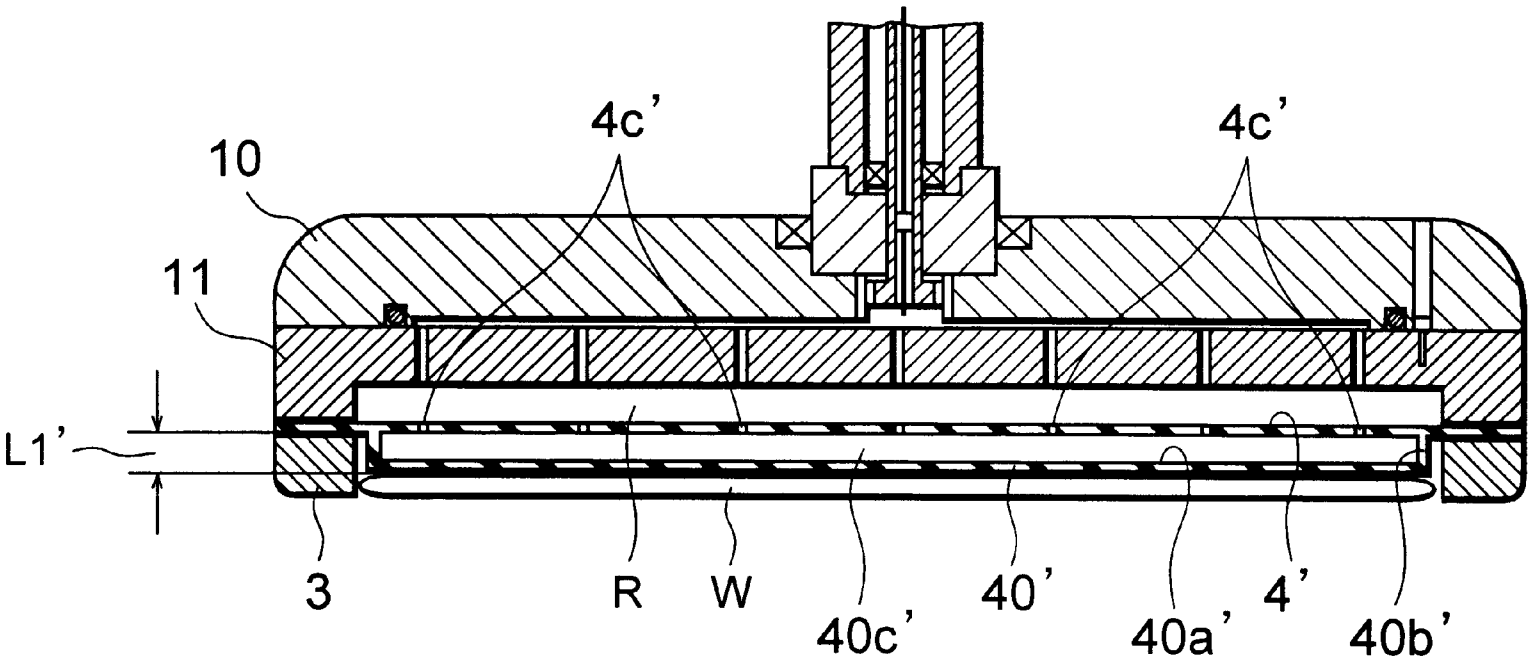
FIG. 8 is a sectional view of a carrier of a polishing apparatus according to a second embodiment of the present invention.

FIG. 8 is a sectional view of a carrier, which is an essential portion of a polishing apparatus according to a second embodiment of the present invention.

The carrier 1 of this embodiment differs from that of the first embodiment of the invention in the structure of the margin block.

The margin block 40 in the carrier 1 of the first embodiment of the invention is solid, so the margin block 40 becomes too thick and hard and it is no longer possible to maintain the front side reference of the wafer W. Therefore, it is not possible to make the margin block 40 too thick.

In this embodiment of the invention, instead of the solid margin block 40, a hollow margin block 40' is provided projecting out from the bottom surface of the sheet 4'. Specifically, the thickness of the bottom surface 40*a'* of the margin block 40' and the thickness of the side surface 40*b'* are set to become substantially equal to the thickness of the sheet 4. The sheet 4' is formed with a plurality of holes 4*c'* for communicating the hollow portion 40*c'* of the margin block 40' and the pressure chamber R. Further, the thickness L1' of the margin block 40' is set to a value in the range from 4 mm to 10 mm.

Due to this configuration, the bottom surface 40*a'* of the margin block 40' deforms in accordance with the unevenness of the top surface of the wafer W and the entire surface of the wafer W is uniformly pressed against by the air inside the hollow portion 40*c'*. Further, since the entire margin block 40' is soft, like a balloon, even if the thickness L1' is the maximum 10 mm, it will not become hard like the margin block 40 in the first embodiment of the invention and the front side reference of the wafer W is maintained. Therefore, it is possible to increase the thickness of the retainer ring 3 in accordance with the thickness L1' of the margin block 40'. As a result, polishing work taking a long period of time is possible by a single retainer ring 3 and it is possible to polish a greater number of wafers W as compared to the margin block 40 of the first embodiment of the invention.

The rest of the configuration, operation, and effects are similar to those of the first embodiment, so the explanation thereof will be omitted.

Note that the present invention is not limited to the above embodiments. Various modifications and changes are possible in the scope of the gist of the invention.

Figure 9:
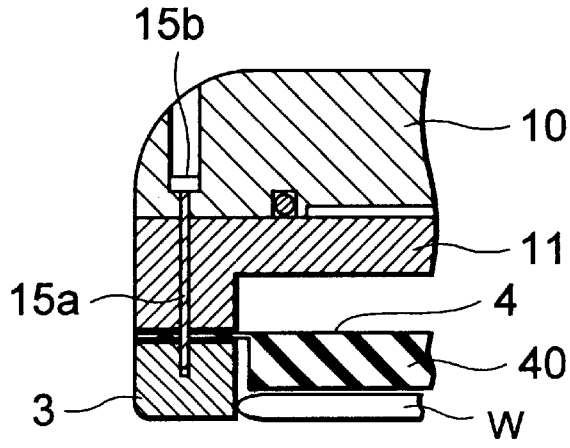
FIG. 9 is a schematic sectional view of a modification where the retainer ring is bolted into place.

For example, in the above embodiments, the outer periphery of the top surface of the sheet 4 was bonded air-tightly with the bottom surface of the carrier base 11 by an adhesive 4*a* and the retainer ring 3 was bonded to the outer periphery of the bottom surface of the sheet 4 by the adhesive 4*b*. However, as shown in FIG. 9, it is also possible to provide a plurality of female threaded holes 15*a* opening to the top surface of the housing 10 and passing through the carrier base 11 and sheet 4 to reach the retainer ring 3 and screw the male screws 15*b* to the female screw holes 15*a* to affix the retainer ring 3. Due to this, it is possible to firmly affix the retainer ring 3.

Figure 10:
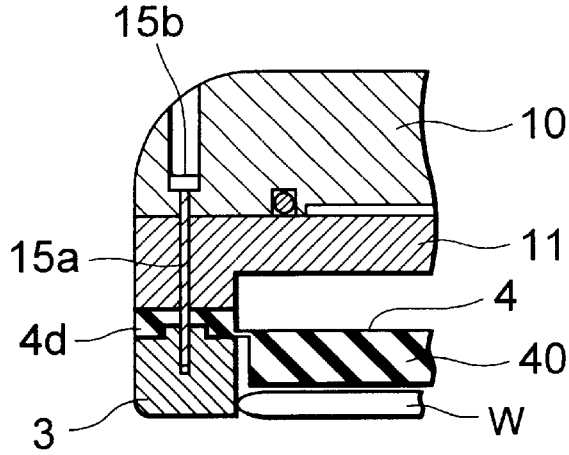
FIG. 10 is a partial enlarged sectional view of a modification where the outer periphery of the sheet is made thick.

Further, as shown in FIG. 10, it is also possible to increase the thickness to the outer periphery 4*d* of the sheet 4 to increase the strength of the outer periphery 4.

Figure 11:
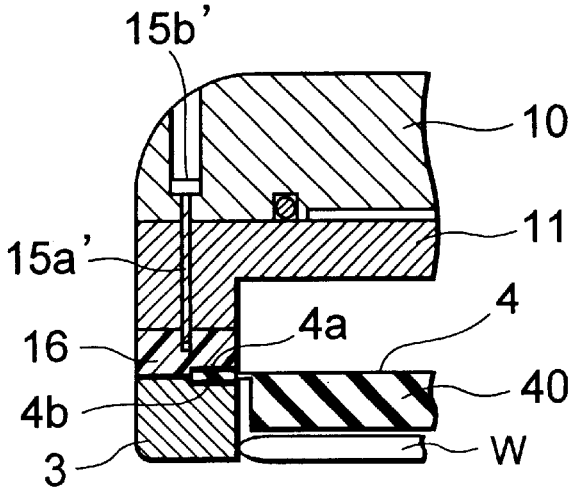
FIG. 11 is a partial enlarged sectional view of a modification where a ring member is interposed between the carrier base and the sheet.

Further, as shown in FIG. 11, it is also possible to construct this by interposing a ring member 16 between the outer periphery of the bottom surface of the carrier base 11 and the outer periphery of the top surface of the sheet 4, bonding the ring member 16, the sheet 4, and the retainer ring 3 by adhesives 4*a*, 4*b*, respectively to form a single assembly, providing a plurality of female threaded holes 15*a'* opening to the top surface of the housing 10, passing through the carrier base 11, and reaching the ring member 16, and screwing male screws 15*b'* into the female threaded holes 15*a'* to affix the ring member 16 to the bottom of the carrier base 11. Due to this, it is possible to detach the ring member 16, sheet 4, and retainer ring 3 in one unit from the carrier base 11 by unscrewing the male screws 15*b* from the female threaded holes 15*a'*.

Further, in the above first embodiment of the invention, the margin block 40 was formed integrally with the sheet 4, but it is also possible to form the margin block 40 separately and adhere the margin block 40 to the bottom surface of the sheet 4 by an adhesive.

Figure 12:
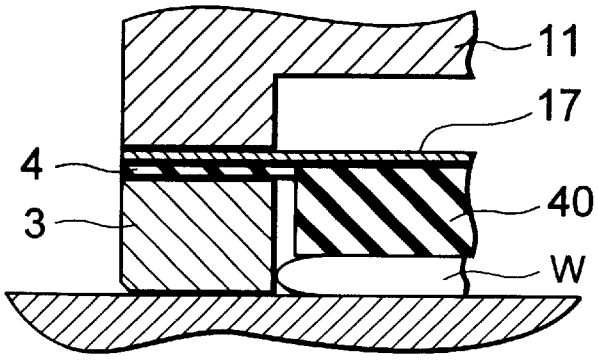
FIG. 12 is a partial enlarged sectional view of a modification where the sheet is made a two-layer construction.
Figure 13:
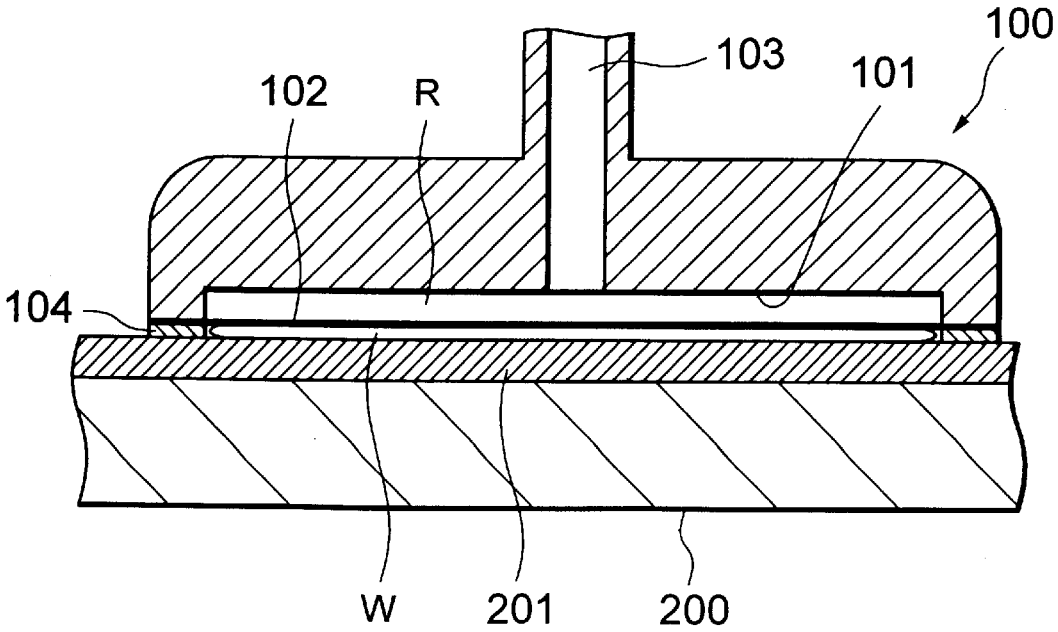
FIG. 13 (PRIOR ART)
FIG. 13 is a sectional view of an example of an air pressure type carrier of the related art.

Further, as shown in FIG. 12, it is also possible to adhere a PVC (polyvinyl chloride) sheet 17 adhered to the top surface of the sheet 4.

As explained in detail above, according to the aspects of the invention, since the thickness of the retainer ring is set to be substantially equal to the sum of the thickness of the pliable margin block and the thickness of the wafer or set much thicker than the retainer ring of the related art, it is possible to use the retainer ring continuously for a long period of time. As a result, there is the superior effect that it is possible to use a retainer ring formed by a soft material to improve the mass producibility of the wafers.

Further, according to embodiments of the invention, since the margin block is formed by an inexpensive rubber material, the manufacturing costs of the carrier can be reduced by that amount.

Further, according to embodiments of the invention, since the margin block is formed by a hollow rubber member, it is possible to increase the thickness of the margin block and further increase the lifetime of the retainer ring.

According to the embodiment of the invention, it is possible to firmly fix the retainer ring in place by screws.

Further, according to the embodiment of the invention, it is possible to remove the screws to detach the bonded ring member, pliable sheet, and retainer ring from the carrier body in one piece.

What is claimed is:

1. A carrier for carrying a wafer having front and back surfaces, said carrier comprising:

a carrier body having a pressure chamber formed by a depression opening downward covered from below by a pliable sheet;

a retainer ring for holding the wafer, said retainer ring being attached to the outer periphery of the bottom surface of the pliable sheet and being formed by a soft material; and a pliable margin block having a bottom surface that deforms in accordance with the back surface of the wafer, said pliable margin block projecting out an equal thickness at the bottom surface of the pliable sheet and being positioned at the inside of said retainer ring;

wherein a bottom surface of the retainer ring and a front surface of the wafer are substantially coplanar when the wafer is positioned within the carrier for polishing.

2. A carrier as set forth in claim 1, wherein said margin block is formed by a solid rubber member.

3. A carrier as set forth in claim 2, wherein the thickness of said margin block is set to a value in the range from 2 mm to 4 mm.

4. A carrier as set forth in claim 1, wherein said margin block is formed by a hollow rubber member and a plurality of holes communicating between the pressure chamber and the hollow part of said margin block are formed in the pliable sheet.

5. A carrier as set forth in claim 4, wherein the thickness of said margin block is set to a value in the range from 4 mm to 10 mm.

6. A carrier as set forth in claim 1, wherein said retainer ring is formed by a material selected from the group consisting of epoxy glass, polyvinyl chloride, polyacetal, polyimide, polyphenylene sulfide, polyether ether ketone, polyethylene terephthalate, polyether sulfone, polysulfone, polyphenylene oxide, polyarylate, and high density polyethylene.

7. A carrier as set forth in claim 1, wherein the outer periphery of the top surface of the pliable sheet is bonded to the outer periphery of the bottom surface of said carrier body by an adhesive and the top surface of said retainer ring is bonded to the outer periphery of the bottom surface of the pliable sheet by an adhesive, and a plurality of female threaded holes are provided opening to the top surface of said carrier body and passing through the pliable sheet to reach said retainer ring and male screws are screwed into the female threaded holes to affix said retainer ring.

8. A carrier as set forth in claim 1, wherein a ring member is interposed between the outer periphery of the bottom surface of said carrier body and the outer periphery of the top surface of the pliable sheet, the bottom surface of said ring member and the outer periphery of the top surface of the pliable sheet are bonded by an adhesive, and the outer periphery of the bottom surface of the pliable sheet and the top surface of said retainer ring are bonded by an adhesive, and a plurality of female threaded holes are provided opening to the top surface of said carrier body and reaching said ring member and male screws are screwed into the female threaded holes to affix said ring member.

9. A carrier as set forth in claim 1, wherein the thickness of said retainer ring is substantially equal to the sum of the thickness of said margin block and the thickness of the wafer being polished.

10. A polishing apparatus comprising:

a rotatable lower platen;

a carrier provided with a carrier body having a pressure chamber formed by a depression opening downward covered from below by a pliable sheet, a retainer ring for holding the wafer, said retainer ring being attached to the outer periphery of the bottom surface of the pliable sheet and being formed by a soft material, and a pliable margin block having a bottom surface that deforms in accordance with the back surface of the wafer, said pliable margin block projecting out at an equal thickness at the bottom surface of the pliable sheet and being positioned at the inside of the retainer ring;

wherein a bottom surface of the retainer ring and a front surface of the wafer are substantially coplanar when the wafer is positioned within the carrier for polishing; and a rotary drive means for making said carrier rotate while pressing it on top of said lower platen.

11. A polishing apparatus as set forth in claim 10, wherein the margin block of said carrier is formed by a solid rubber member.

12. A polishing apparatus as set forth in claim 10, wherein the margin block of said carrier is formed by a hollow rubber member, and a plurality of holes communicating between the pressure chamber of the carrier body and the hollow part of the margin block are formed in the pliable sheet.

13. A polishing apparatus as set forth in claim 10, wherein the retainer ring is formed by a material selected from the group consisting of epoxy glass, polyvinyl chloride, polyacetal, polyimide, polyphenylene sulfide, polyether ether ketone, polyethylene terephthalate, polyether sulfone, polysulfone, polyphenylene oxide, polyarylate, and high density polyethylene.

14. A carrier as set forth in claim 10, wherein the thickness of said retainer ring is substantially equal to the sum of the thickness of said margin block and the thickness of the wafer being polished.

* * * * *